US010013924B2

(12) United States Patent
Zhong

(10) Patent No.: US 10,013,924 B2
(45) Date of Patent: Jul. 3, 2018

(54) METHOD FOR ADJUSTING BACKLIGHT BRIGHTNESS AND ELECTRONIC DEVICE

(71) Applicant: HUAWEI DEVICE (DONGGUAN) CO., LTD., Dongguan (CN)

(72) Inventor: Guanghua Zhong, Shenzhen (CN)

(73) Assignee: Huawei Device (Dongguan) Co., Ltd., Dongguan (CN)

( * ) Notice: Subject to any disclaimer, the term of this patent is extended or adjusted under 35 U.S.C. 154(b) by 0 days.

(21) Appl. No.: 15/124,275

(22) PCT Filed: Mar. 13, 2014

(86) PCT No.: PCT/CN2014/073402

§ 371 (c)(1),
(2) Date: Sep. 7, 2016

(87) PCT Pub. No.: WO2015/135187

PCT Pub. Date: Sep. 17, 2015

(65) Prior Publication Data

US 2017/0018233 A1 Jan. 19, 2017

(51) Int. Cl.
*G09G 3/34* (2006.01)

(52) U.S. Cl.
CPC ... *G09G 3/3406* (2013.01); *G09G 2320/0247* (2013.01); *G09G 2320/062* (2013.01); *G09G 2320/0626* (2013.01); *G09G 2360/144* (2013.01); *G09G 2360/16* (2013.01)

(58) Field of Classification Search
None
See application file for complete search history.

(56) References Cited

U.S. PATENT DOCUMENTS

2004/0223007 A1 11/2004 Mamata
2007/0211046 A1 9/2007 Taylor et al.
2009/0243496 A1 10/2009 Lee et al.
(Continued)

FOREIGN PATENT DOCUMENTS

CN 1617220 A 5/2005
CN 101383139 A 3/2009
(Continued)

OTHER PUBLICATIONS

Office Action issued in Chinese Application No. 201480032786.3 dated Oct. 20, 2016, 7 pages.
(Continued)

*Primary Examiner* — Kenneth B Lee, Jr.
(74) *Attorney, Agent, or Firm* — Fish & Richardson P.C.

(57) ABSTRACT

An electronic device includes a light sensor and a microcontroller connected to the light sensor, where the light sensor is configured to acquire an ambient luminance signal of a current time point; and the microcontroller is configured to: read the ambient luminance signal of the current time point from the light sensor, and obtain through calculation a first target backlight brightness value of the electronic device at the current time point according to the ambient luminance signal of the current time point, where the microcontroller is further configured to: if the electronic device is in a normal screen-on state, adjust from a first initial backlight brightness value to the first target backlight brightness value step by step, where the first initial backlight brightness value is a first target backlight brightness value of the electronic device at a previous time point.

20 Claims, 4 Drawing Sheets

(56) References Cited

U.S. PATENT DOCUMENTS

| | | | |
|---|---|---|---|
| 2010/0188325 | A1 | 7/2010 | Inoue |
| 2011/0181541 | A1 | 7/2011 | Kuo |
| 2013/0147864 | A1 | 6/2013 | Kim et al. |
| 2014/0022223 | A1 | 1/2014 | Jung |

FOREIGN PATENT DOCUMENTS

| | | | |
|---|---|---|---|
| CN | 201765808 | U | 3/2011 |
| CN | 102097056 | A | 6/2011 |
| CN | 102800301 | A | 11/2012 |
| CN | 103247281 | A | 8/2013 |
| JP | 2004279503 | A | 10/2004 |
| JP | 2007011304 | A | 1/2007 |
| JP | 2008052131 | A | 3/2008 |
| JP | 2009271169 | A | 11/2009 |
| JP | 2011034026 | A | 2/2011 |
| KR | 20090104456 | A | 10/2009 |

OTHER PUBLICATIONS

Extended European Search Report issued in European Application No. 14885829.3 dated Feb. 15, 2017, 6 pages.
International Search Report issued in International Application No. PCT/CN2014/073402, dated Nov. 25, 2014.
International Search Report issued in International Application No. PCT/CN/2014/073402, dated Nov. 25, 2014.
Notice of Reasons for Rejection issued in Japanese Application No. 2016-556924 dated Oct. 23, 2017; 9 pages.
Korean Office Action in Korean Application No. 10-2016-7026266, dated Nov. 20, 2017, 8 pages.

METHOD FOR ADJUSTING BACKLIGHT BRIGHTNESS AND ELECTRONIC DEVICE

CROSS-REFERENCE TO RELATED APPLICATIONS

This application is a National Stage of International Application No. PCT/CN2014/073402, filed on Mar. 13, 2014, which is hereby incorporated by reference in its entirety.

TECHNICAL FIELD

The present invention relates to the field of manufacturing of liquid crystal displays, and in particular, to a method for adjusting backlight brightness and an electronic device.

BACKGROUND

In recent years, liquid crystal displays (Liquid Crystal Display, LCD for short) have been developing by leaps and bounds, and are widely applied in fields such as smartphones, industrial meters, and medical instruments, bringing richer visual enjoyment to users.

However, an LCD is a passive light-emitting display, whose display effect is greatly related to LCD backlight brightness and ambient luminance. For example, backlight brightness of an LCD in the sun must be adjusted to a very high level to ensure that the LCD presents clear display content; inside a dark place, the LCD may present clear display content only by maintaining a relatively low level of backlight brightness of the LCD.

To ensure that an LCD can still present clear display content when ambient luminance changes, methods of light adaptive brightness control (Light Adaptive Brightness Control, LABC for short) and content adaptive brightness control (Content Adaptive Brightness Control, CABC for short) are proposed in the prior art.

Exemplarily, in the LABC method, after an electronic device is turned on, an application processor (Application Processor, AP for short) first checks ambient luminance, then obtains through calculation current LCD backlight brightness according to the ambient luminance, and transmits to an LCD driver circuit the LCD backlight brightness obtained through calculation. In this way, the LCD driver circuit can output a pulse width modulation (Pulse Width Modulation, PWM for short) signal to a backlight driver module, so that the current LCD backlight brightness can be adjusted. If the ambient luminance exceeds a particular range, the electronic device starts the foregoing process again to re-adjust the LCD backlight brightness.

However, in the current LABC method, LCD backlight cannot track ambient light changes in real time. As shown in FIG. 1, there is much blank space between a straight line indicating LCD backlight brightness and a curve indicating ambient luminance, where the blank space indicates wasted energy. In addition, because a PWM signal output by an LCD driver circuit is not highly precise, 8 bits generally, a sudden backlight change occurs when the LCD backlight brightness changes. As a result, a user sees obvious flickering in a light adjustment process.

SUMMARY

Embodiments of the present invention provide a method for adjusting backlight brightness and an electronic device, so as to resolve a problem that, in a process of adjusting backlight brightness of an LCD, a user sees obvious flickering in the light adjustment process.

To achieve the foregoing objective, the following technical solutions are used in the embodiments of the present invention:

According to a first aspect, an embodiment of the present invention provides an electronic device, including a light sensor and a microcontroller connected to the light sensor, where

- the light sensor is configured to acquire an ambient luminance signal of a current time point; and
- the microcontroller is configured to: read the ambient luminance signal of the current time point from the light sensor, and obtain through calculation a first target backlight brightness value of the electronic device at the current time point according to the ambient luminance signal of the current time point, where
- the microcontroller is further configured to: if the electronic device is in a normal screen-on state, adjust from a first initial backlight brightness value to the first target backlight brightness value step by step, where the first initial backlight brightness value is a first target backlight brightness value of the electronic device at a previous time point.

In a first possible implementation manner of the first aspect, the microcontroller is specifically configured to:

- perform filtering processing on the read ambient luminance signal of the current time point to obtain an after-filtering ambient luminance signal of the current time point; and
- if the after-filtering ambient luminance signal of the current time point changes relative to an ambient luminance signal of the previous time point, obtain through calculation the first target backlight brightness value of the electronic device at the current time point according to the after-filtering ambient luminance signal of the current time point.

In a second possible implementation manner of the first aspect, the microcontroller is specifically configured to:

- acquire an initial brightness change rate corresponding to the first initial backlight brightness value, and adjust to a first first intermediate backlight brightness value according to the initial brightness change rate; and
- obtain an intermediate brightness change rate corresponding to a first intermediate backlight brightness value, and adjust to a next first intermediate backlight brightness value according to the intermediate brightness change rate, cyclically until the first target backlight brightness value of the electronic device is reached.

With reference to the first aspect or either of the foregoing two possible implementation manners of the first aspect, a third possible implementation manner of the first aspect is further provided, where the electronic device further includes: an application processor, a display driver module connected to the application processor and the microcontroller, and a backlight driver module connected to the microcontroller, where

- the application processor is configured to output an image to the display driver module;
- the display driver module is configured to acquire a second target backlight brightness value of the electronic device at the current time point according to the image input by the application processor;
- the microcontroller is configured to: multiply the first target backlight brightness value and the second target backlight brightness value to obtain a third target backlight brightness value of the electronic device, and output the third target backlight brightness value to the backlight driver module; and the backlight driver module is configured to adjust backlight brightness of the electronic device according to the third target backlight brightness value.

With reference to the third possible implementation manner of the first aspect, a fourth possible implementation manner of the first aspect is further provided, where the application processor is further configured to send an instruction message to the microcontroller, where the instruction message is used to instruct the microcontroller to turn on or turn off the light sensor.

According to a second aspect, an embodiment of the present invention provides a method for adjusting backlight brightness, applied to an electronic device, where the adjustment method includes:

acquiring an ambient luminance signal of a current time point;

obtaining through calculation a first target backlight brightness value of the electronic device at the current time point according to the ambient luminance signal of the current time point; and if the electronic device is in a normal screen-on state, adjusting from a first initial backlight brightness value to the first target backlight brightness value step by step, where the first initial backlight brightness value is a first target backlight brightness value of the electronic device at a previous time point.

In a first possible implementation manner of the second aspect, the obtaining through calculation a first target backlight brightness value of the electronic device at the current time point according to the ambient luminance signal of the current time point includes:

performing filtering processing on the ambient luminance signal of the current time point to obtain an after-filtering ambient luminance signal of the current time point; and if the after-filtering ambient luminance signal of the current time point changes relative to an ambient luminance signal of the previous time point, obtaining through calculation the first target backlight brightness value of the electronic device at the current time point according to the after-filtering ambient luminance signal of the current time point.

In a second possible implementation manner of the second aspect, the adjusting from a first initial backlight brightness value to the first target backlight brightness value step by step includes:

acquiring an initial brightness change rate corresponding to the first initial backlight brightness value, and adjusting to a first first intermediate backlight brightness value according to the initial brightness change rate; and obtaining an intermediate brightness change rate corresponding to a first intermediate backlight brightness value, and adjusting to a next first intermediate backlight brightness value according to the intermediate brightness change rate, cyclically until the first target backlight brightness value of the electronic device is reached.

With reference to the second aspect or either of the foregoing two possible implementation manners of the second aspect, a third possible implementation manner of the second aspect is further provided, where the adjustment method further includes:

acquiring a second target backlight brightness value of the electronic device at the current time point according to an image input to the electronic device; and multiplying the first target backlight brightness value and the second target backlight brightness value to obtain a third target backlight brightness value, so that the electronic device adjusts backlight brightness according to the third target backlight brightness value.

The embodiments of the present invention provide a method for adjusting backlight brightness and an electronic device. A light sensor is configured to acquire an ambient luminance signal of a current time point; the microcontroller is configured to: read the ambient luminance signal of the current time point from the light sensor, obtain through calculation a first target backlight brightness value of the electronic device at the current time point according to the ambient luminance signal of the current time point, and if the electronic device is in a normal screen-on state, adjust from a first initial backlight brightness value to the first target backlight brightness value step by step, where the first initial backlight brightness value is a first target backlight brightness value of the electronic device at a previous time point. This resolves a problem that, in a process of adjusting backlight brightness of an LCD, a user sees obvious flickering in the light adjustment process.

BRIEF DESCRIPTION OF DRAWINGS

To describe the technical solutions in the embodiments of the present invention more clearly, the following briefly introduces the accompanying drawings required for describing the embodiments or the prior art. Apparently, the accompanying drawings in the following description show merely some embodiments of the present invention, and a person of ordinary skill in the art may still derive other drawings from these accompanying drawings without creative efforts.

DESCRIPTION OF EMBODIMENTS

The following clearly and completely describes the technical solutions in the embodiments of the present invention with reference to the accompanying drawings in the embodiments of the present invention. Apparently, the described embodiments are merely some but not all of the embodiments of the present invention. All other embodiments obtained by persons of ordinary skill in the art based on the embodiments of the present invention without creative efforts shall fall within the protection scope of the present invention.

Embodiment 1

Figure 1:
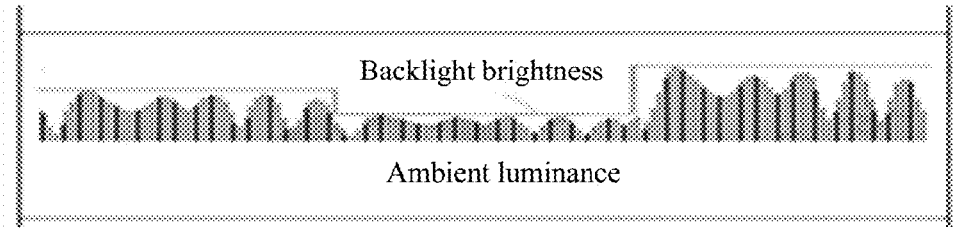
FIG. 1 is a schematic diagram of changes of LCD backlight brightness in an LABC method provided in the prior art.
Figure 2:
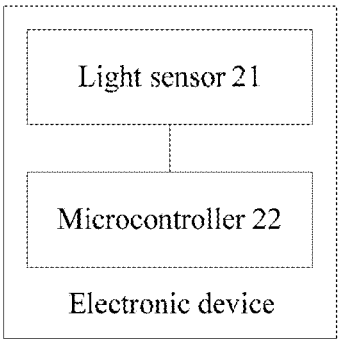
FIG. 2 is a schematic diagram of an electronic device according to an embodiment of the present invention.

This embodiment of the present invention provides an electronic device. As shown in FIG. 2, the electronic device includes: a light sensor 21 and a microcontroller 22 connected to the light sensor 21.

The light sensor 21 is configured to acquire an ambient luminance signal of a current time point; and the microcontroller 22 is configured to: read the ambient luminance signal of the current time point from the light sensor 21, and obtain through calculation a first target backlight brightness value of the electronic device at the current time point according to the ambient luminance signal of the current time point, where the microcontroller 22 is further configured to: if the electronic device is in a normal screen-on state, adjust from a first initial backlight brightness value to the first target backlight brightness value step by step, where the first initial backlight brightness value is a first target backlight brightness value of the electronic device at a previous time point.

The ambient luminance signal may be an electrical signal converted by the light sensor 21 from an optical signal obtained in a current environment, where the electrical signal may be a current signal or a voltage signal, without being limited thereto though. The first target backlight brightness value is obtained according to the principle of light adaptive brightness control (Light Adaptive Brightness Control, LABC for short).

Optionally, the microcontroller 22 is specifically configured to: perform filtering processing on the read ambient luminance signal of the current time point to obtain an after-filtering ambient luminance signal of the current time point; and if the after-filtering ambient luminance signal of the current time point changes relative to an ambient luminance signal of the previous time point, obtain through calculation the first target backlight brightness value of the electronic device at the current time point according to the after-filtering ambient luminance signal of the current time point.

Specifically, the microcontroller 22 performs filtering processing on continuously read ambient light to obtain an after-filtering ambient light curve, obtains current ambient luminance from the ambient light curve, and further obtains the first target backlight brightness value according to the ambient luminance.

When the microcontroller 22 reads the ambient luminance signal of the current time point, if the light sensor 21 is directed abruptly to a strong light-emitting illuminant such as an electric light or the sun, data of the sudden change does not reflect the actual change of ambient luminance. Therefore, filtering processing needs to be performed on the read ambient luminance signal of the current time point, to obtain the actual ambient luminance change, that is, to obtain the after-filtering ambient luminance signal of the current time point. The filtering processing may be performed by using various algorithms for smoothing data, such as an average method, a weighting method, and an interpolation method.

Exemplarily, a first-order lag filtering algorithm is used as an example. The principle of the first-order lag filtering algorithm is: a current filtering result=(1−a)*a current sample value+a*a previous filtering result, where $0<a<1$. X(K) represents the current filtering result, X(K−1) represents the previous filtering result, and U(k) represents the current sample value, and then X(K)=(1−a)*U(k)+a*X(K−1).

Figure 3:
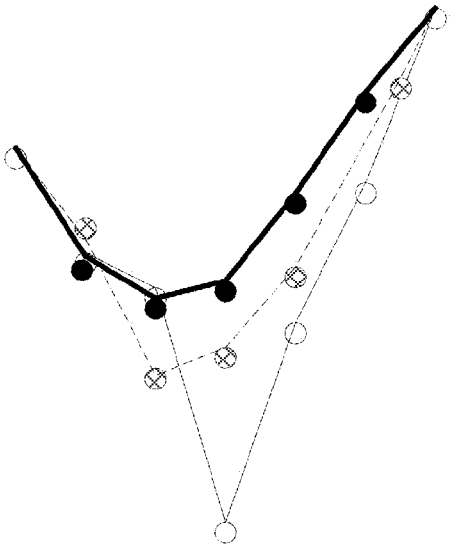
FIG. 3 is a schematic diagram of a first-order lag filtering algorithm in the prior art.

As shown in FIG. 3, hollow circles, connected by using a thin solid line, represent signals on which filtering processing is not performed. Let a be 0.8. After the first-order lag filtering algorithm is applied and then X(K)=[X(K−1)+X(K+1)]/2 is further applied once, circles filled with double slashes shown in FIG. 3 are obtained, where the circles are connected by using a dashed line. This is repeated several times until black solid circles shown in FIG. 3 are obtained, where the solid circles are connected by using a bold solid line.

Figure 4:
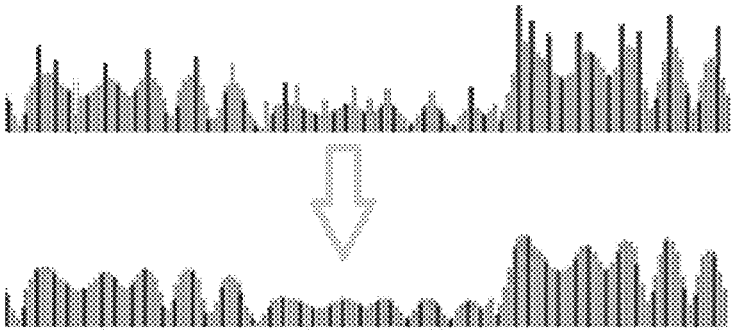
FIG. 4 is a schematic diagram of an ambient light filtering effect that is obtained by using a first-order lag filtering algorithm according to an embodiment of the present invention.

As shown in FIG. 4, FIG. 4 shows an after-filtering ambient luminance signal of the current time point obtained after the microcontroller 22 performs, by using the first-order lag filtering algorithm, filtering processing on the read ambient luminance signal of the current time point.

Optionally, the microcontroller 22 is specifically configured to:

acquire an initial brightness change rate corresponding to the first initial backlight brightness value, and adjust to a first first intermediate backlight brightness value according to the initial brightness change rate; and obtain an intermediate brightness change rate corresponding to a first intermediate backlight brightness value, and adjust to a next first intermediate backlight brightness value according to the intermediate brightness change rate, cyclically until the first target backlight brightness value of the electronic device is reached.

If the ambient luminance signal of the current time point changes slightly relative to that of the previous time point, the first first intermediate backlight brightness value can serve as the first target backlight brightness value of the electronic device. In this case, the first target backlight brightness value of the electronic device can be reached by acquiring the initial brightness change rate corresponding to the first initial backlight brightness value and adjusting according to the initial brightness change rate only once.

If the ambient luminance signal of the current time point changes significantly relative to that of the previous time point, there is a large gap between the first initial backlight brightness value and the first target backlight brightness value. In this case, the first initial backlight brightness value needs to go through multiple first intermediate backlight brightness values so as to adjust to the first target backlight brightness value of the electronic device. Specifically, the initial brightness change rate corresponding to the first intermediate backlight brightness value is acquired and the first first intermediate backlight brightness value is reached by adjusting according to the initial brightness change rate; an intermediate brightness change rate corresponding to the first intermediate backlight brightness value is acquired, and a second first intermediate backlight brightness value is reached by adjusting according to the intermediate brightness change rate; the adjustment goes on until the first target backlight brightness value of the electronic device is reached.

Human eyes are extremely sensitive to brightness changes. Therefore, the initial brightness change rate corresponding to the first initial backlight brightness value and the intermediate brightness change rate corresponding to the first intermediate backlight brightness value need to ensure that the first backlight brightness is adjusted to the first target backlight brightness value of the electronic device at a highest rate with a largest change amount that are not to visual awareness of the human eyes. When a screen of the electronic device is darker, a gradual change of screen brightness should take a longer time at a lower transition rate. When the screen of the electronic device is brighter, the gradual change of screen brightness should take a shorter time at a higher transition rate.

Figure 5:
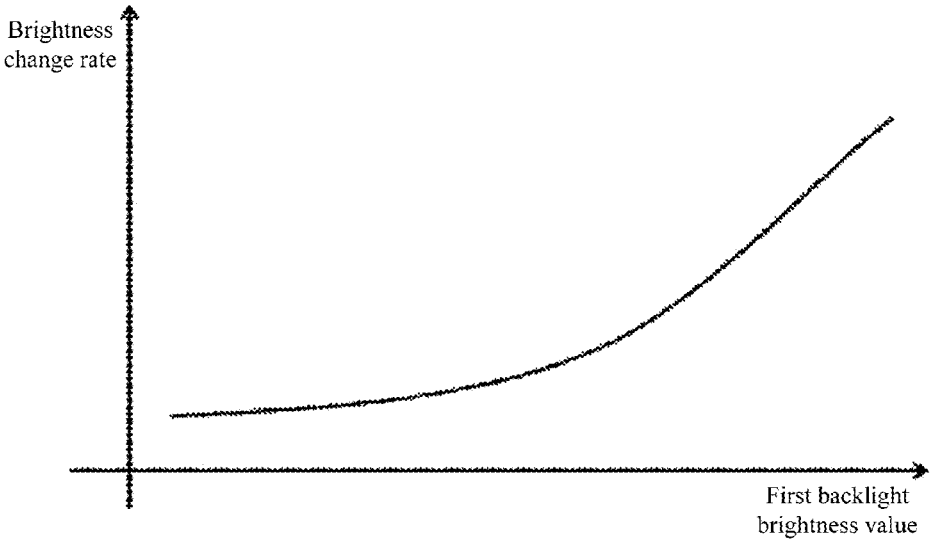
FIG. 5 is a schematic diagram of a curve of sensitivity of human eyes to brightness according to an embodiment of the present invention.

Exemplarily, a curve of luminance sensitivity of the human eyes in different levels of ambient luminance is obtained by testing according to visual characteristics of the human eyes. According to this curve, an asymptote may be found for a highest rate and a largest change amount that are not to visual awareness of the human eyes. As shown in FIG. 5, a horizontal coordinate represents a first backlight brightness value, and a vertical coordinate represents a brightness change rate. A further understanding of the relationship between the first backlight brightness value and the brightness change rate shown in FIG. 5 is that a visual response of the human eyes is actually caused by a slope of brightness change. When the slope of brightness change is less than a constant value, a visual response is not made; when the slope of brightness change is greater than the constant value, a visual response is made. Significance of the brightness change slope curve shown in FIG. 5 is: In given ambient light, when the first backlight brightness value changes from an initial value to a target value, a slope of the change approaches the luminance sensitivity curve, so that a largest change amount can be obtained and brightness follows at a highest speed, achieving an optimal display effect without visual awareness of the human eyes.

Figure 6:
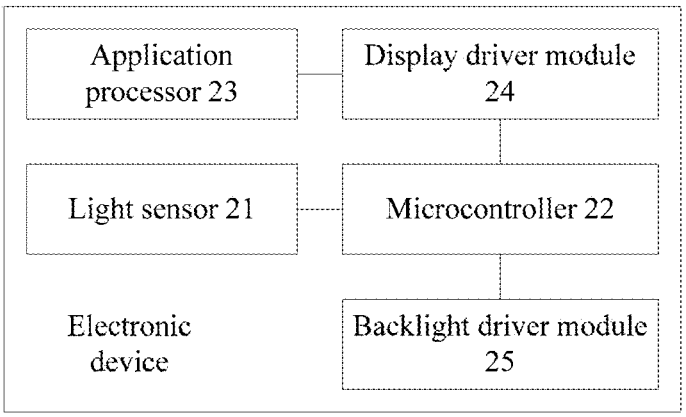
FIG. 6 is a schematic diagram of an electronic device according to another embodiment of the present invention.

Optionally, as shown in FIG. 6, the electronic device further includes: an application processor 23, a display driver module 24 connected to the application processor 23 and the microcontroller 22, and a backlight driver module 25 connected to the microcontroller 22.

The application processor 23 is configured to output an image to the display driver module 24.

The display driver module 24 is configured to acquire a second target backlight brightness value of the electronic device at the current time point according to the image input by the application processor 23.

The microcontroller 22 is configured to: multiply the first target backlight brightness value and the second target backlight brightness value to obtain a third target backlight brightness value of the electronic device, and output the third target backlight brightness value to the backlight driver module 25.

The backlight driver module 25 is configured to adjust backlight brightness of the electronic device according to the third target backlight brightness value.

The second target backlight brightness value is obtained according to the principle of content adaptive brightness control (Content Adaptive Brightness Control, CABC for short).

Optionally, the application processor 23 is further configured to send an instruction message to the microcontroller 22, where the instruction message is used to instruct the microcontroller 22 to turn on or turn off the light sensor 21.

The instruction message may be a startup or shutdown command. When the microcontroller 22 receives a startup command sent by the application processor 23, the microcontroller 22 turns on the light sensor 21. When the microcontroller 22 receives a shutdown command sent by the application processor 23, the microcontroller 22 turns off the light sensor 21.

Alternatively, the instruction message may be a wakeup or sleep command. When the microcontroller 22 receives a wakeup command sent by the application processor 23, the microcontroller 22 turns on the light sensor 21. When the microcontroller 22 receives a sleep command sent by the application processor 23, the microcontroller 22 turns off the light sensor 21.

Alternatively, the instruction message may be a command indicating whether to adjust backlight brightness. When the microcontroller 22 receives a command of adjusting backlight brightness sent by the application processor 23, the microcontroller 22 turns on the light sensor 21. When the microcontroller 22 receives a command of not adjusting backlight brightness sent by the application processor 23, the microcontroller 22 turns off the light sensor 21.

This embodiment of the present invention provides an electronic device. The electronic device includes a light sensor and a microcontroller connected to the light sensor. The light sensor is configured to acquire an ambient luminance signal of a current time point; the microcontroller is configured to: read the ambient luminance signal of the current time point from the light sensor, obtain through calculation a first target backlight brightness value of the electronic device at the current time point according to the ambient luminance signal of the current time point, and if the electronic device is in a normal screen-on state, adjust from a first initial backlight brightness value to the first target backlight brightness value step by step, where the first initial backlight brightness value is a first target backlight brightness value of the electronic device at a previous time point. This resolves a problem that, in a process of adjusting backlight brightness of an LCD, a user sees obvious flickering in the light adjustment process.

Embodiment 2

Figure 7:
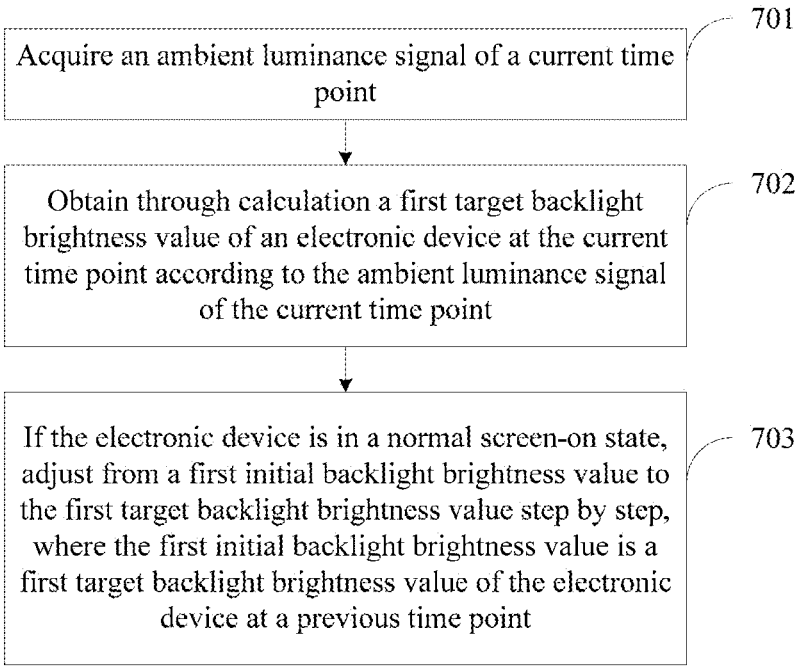
FIG. 7 is a schematic diagram of a method for adjusting backlight brightness according to an embodiment of the present invention.

This embodiment of the present invention further provides a method for adjusting backlight brightness, where the adjustment method is applied to an electronic device. As shown in FIG. 7, the adjustment method includes:

701: Acquire an ambient luminance signal of a current time point.

The ambient luminance signal is an electrical signal that is converted from the optical signal, where the electrical signal may be a current signal or a voltage signal, without being limited thereto though.

702: Obtain through calculation a first target backlight brightness value of the electronic device at the current time point according to the ambient luminance signal of the current time point.

The first target backlight brightness value is obtained according to the principle of LABC.

Optionally, the obtaining through calculation a first target backlight brightness value of the electronic device at the current time point according to the ambient luminance signal of the current time point includes:

performing filtering processing on the ambient luminance signal of the current time point to obtain an after-filtering ambient luminance signal of the current time point; and if the after-filtering ambient luminance signal of the current time point changes relative to an ambient luminance signal of the previous time point, obtaining through calculation the first target backlight brightness value of the electronic device at the current time point according to the after-filtering ambient luminance signal of the current time point.

703: If the electronic device is in a normal screen-on state, adjust from a first initial backlight brightness value to the first target backlight brightness value step by step, where the first initial backlight brightness value is a first target backlight brightness value of the electronic device at a previous time point.

Optionally, the adjusting from a first initial backlight brightness value to the first target backlight brightness value step by step includes:

acquiring an initial brightness change rate corresponding to the first initial backlight brightness value, and adjusting to a first first intermediate backlight brightness value according to the initial brightness change rate; and obtaining an intermediate brightness change rate corresponding to a first intermediate backlight brightness value, and adjusting to a next first intermediate backlight brightness value according to the intermediate brightness change rate, cyclically until the first target backlight brightness value of the electronic device is reached.

Figure 8:
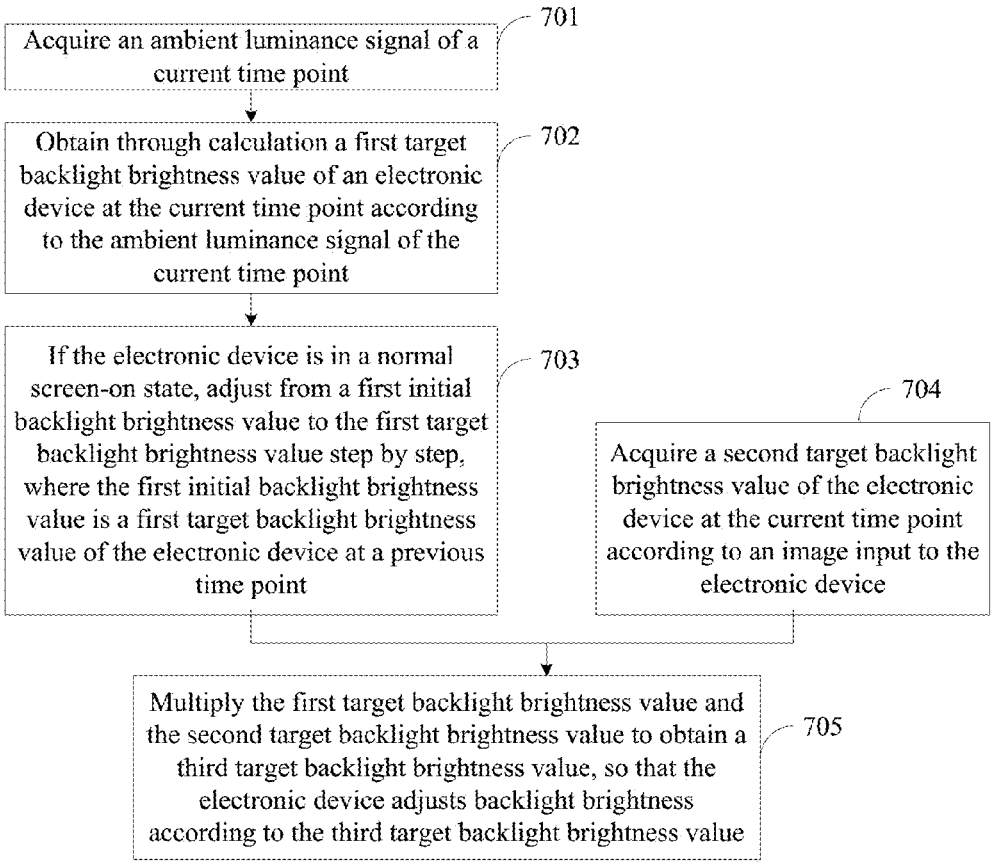
FIG. 8 is a schematic diagram of another method for adjusting backlight brightness according to an embodiment of the present invention.

Optionally, when backlight brightness needs to be adjusted according to content of an image that is input to the electronic device, as shown in FIG. 8, on the basis of steps 701 to 703, the method further includes:

704: Acquire a second target backlight brightness value of the electronic device at the current time point according to the image input to the electronic device.

The second target backlight brightness value is obtained according to the principle of CABC.

705: Multiply the first target backlight brightness value and the second target backlight brightness value to obtain a third target backlight brightness value, so that the electronic device adjusts backlight brightness according to the third target backlight brightness value.

This embodiment of the present invention provides an adjustment method. An ambient luminance signal of a current time point is acquired; a first target backlight brightness value of the electronic device at the current time point is obtained through calculation according to the ambient luminance signal of the current time point; and if the electronic device is in a normal screen-on state, adjustment is performed from a first initial backlight brightness value to the first target backlight brightness value step by step, where the first initial backlight brightness value is a first target backlight brightness value of the electronic device at a previous time point. This resolves a problem that, in a process of adjusting backlight brightness of an LCD, a user sees obvious flickering in the light adjustment process.

In the several embodiments provided in this application, it should be understood that the disclosed system, apparatus, and method may be implemented in other manners. For example, the described apparatus embodiment is merely exemplary. For example, the unit division is merely logical function division or may be other division in actual implementation. For example, a plurality of units or components may be combined or integrated into another system, or some features may be ignored or not performed. In addition, the displayed or discussed mutual couplings or direct couplings or communication connections may be implemented by using some interfaces. The indirect couplings or communication connections between the apparatuses or units may be implemented in electronic, mechanical, or other forms.

The units described as separate parts may or may not be physically separate. Parts displayed as units may or may not be physical units, and may be located in one position or may be distributed on a plurality of network units. Some or all of the units may be selected according to actual needs to achieve the objectives of the solutions of the embodiments.

In addition, functional units in the embodiments of the present invention may be integrated into one processing unit, or each of the units may exist alone physically, or two or more units are integrated into one unit. The integrated unit may be implemented in a form of hardware, or may be implemented in a form of hardware in addition to a software functional unit.

When the foregoing integrated unit is implemented in a form of a software functional unit, the integrated unit may be stored in a computer-readable storage medium. The software functional unit is stored in a storage medium and includes several instructions for instructing a computer device (which may be a personal computer, a server, or a network device) to perform some of the steps of the methods described in the embodiments of the present invention. The foregoing storage medium includes: any medium that can store program code, such as a USB flash drive, a portable hard disk, a read-only memory (Read-Only Memory, ROM for short), a random access memory (Random Access Memory, RAM for short), a magnetic disk, or an optical disc.

Finally, it should be noted that the foregoing embodiments are merely intended to describe the technical solutions of the present invention but not to limit the present invention. Although the present invention is described in detail with reference to the foregoing embodiments, persons of ordinary skill in the art should understand that they may still make modifications to the technical solutions described in the foregoing embodiments or make equivalent replacements to some technical features thereof, without departing from the spirit and scope of the technical solutions of the embodiments of the present invention.

What is claimed is:

1. An electronic device, comprising:

a light sensor;

at least one microcontroller connected to the light sensor; and a non-transitory computer-readable storage medium coupled to the at least one microcontroller and storing programming instructions for execution by the microcontroller, wherein the light sensor is configured to acquire an ambient luminance signal of a current time point; and the programming instructions instruct the at least one microcontroller to:

read the ambient luminance signal of the current time point from the light sensor;

obtain through calculation a first target backlight brightness value of the electronic device at the current time point according to the ambient luminance signal of the current time point, wherein the obtaining through calculation a first target backlight brightness value of the electronic device at the current time point according to the ambient luminance signal of the current time point comprises:

performing filtering processing on the read ambient luminance signal of the current time point for smoothing the ambient luminance signal of the current time point to obtain an after-filtering ambient luminance signal of the current time point; and in response to a determination that the after-filtering ambient luminance signal of the current time point is changed relative to an ambient luminance signal of the previous time point, obtaining through calculation the first target backlight brightness value of the electronic device at the current time point according to the after-filtering ambient luminance signal of the current time point; and if the electronic device is in a normal screen-on state, adjust the electronic device from a first initial backlight brightness value to the first target backlight brightness value step by step, wherein the first initial backlight brightness value is a first target backlight brightness value of the electronic device at a previous time point.

2. The electronic device according to claim 1, wherein the programming instructions further instruct the at least one microcontroller to:

acquire an initial brightness change rate corresponding to the first initial backlight brightness value, and adjust to a first intermediate backlight brightness value according to the initial brightness change rate;

obtain an intermediate brightness change rate corresponding to the first intermediate backlight brightness value; and adjust to a next first intermediate backlight brightness value according to the intermediate brightness change rate.

3. The electronic device according to claim 1, wherein the electronic device further comprises: an application processor, a display driver module connected to the application processor and the at least one microcontroller, and a backlight driver module connected to the at least one microcontroller, wherein:

the application processor is configured to output an image to the display driver module;

the display driver module is configured to acquire a second target backlight brightness value of the electronic device at the current time point according to the image input by the application processor;

the programming instructions further instruct the at least one microcontroller to: multiply the first target backlight brightness value and the second target backlight brightness value to obtain a third target backlight brightness value of the electronic device, and output the third target backlight brightness value to the backlight driver module; and the backlight driver module is configured to adjust backlight brightness of the electronic device according to the third target backlight brightness value.

4. The electronic device according to claim 3, wherein the application processor is further configured to send an instruction message to the at least one microcontroller, wherein the instruction message is used to instruct the at least one microcontroller to turn on or turn off the light sensor.

5. A method for adjusting backlight brightness, applied to an electronic device, wherein the adjustment method comprises:

acquiring an ambient luminance signal of a current time point;

obtaining through calculation a first target backlight brightness value of the electronic device at the current time point according to the ambient luminance signal of the current time point, wherein the obtaining through calculation a first target backlight brightness value of the electronic device at the current time point according to the ambient luminance signal of the current time point comprises:

performing filtering processing on the ambient luminance signal of the current time point for smoothing the ambient luminance signal of the current time point to obtain an after-filtering ambient luminance signal of the current time point; and in response to a determination that the after-filtering ambient luminance signal of the current time point is changed relative to an ambient luminance signal of the previous time point, obtaining through calculation the first target backlight brightness value of the electronic device at the current time point according to the after-filtering ambient luminance signal of the current time point; and if the electronic device is in a normal screen-on state, adjusting the electronic device from a first initial backlight brightness value to the first target backlight brightness value step by step, wherein the first initial backlight brightness value is a first target backlight brightness value of the electronic device at a previous time point.

6. The adjustment method according to claim 5, wherein the adjusting from a first initial backlight brightness value to the first target backlight brightness value step by step comprises:

acquiring an initial brightness change rate corresponding to the first initial backlight brightness value, and adjusting to a first intermediate backlight brightness value according to the initial brightness change rate;

obtaining an intermediate brightness change rate corresponding to the first intermediate backlight brightness value; and adjusting to a next first intermediate backlight brightness value according to the intermediate brightness change rate.

7. The adjustment method according to claim 5, wherein the adjustment method further comprises:

acquiring a second target backlight brightness value of the electronic device at the current time point according to an image input to the electronic device; and multiplying the first target backlight brightness value and the second target backlight brightness value to obtain a third target backlight brightness value, so that the electronic device adjusts backlight brightness according to the third target backlight brightness value.

8. The electronic device according to claim 2, wherein, if the ambient luminance signal of the current time point changes below a threshold relative to that of the previous time point, the first intermediate backlight brightness value serves as the first target backlight brightness value of the current time point.

9. The electronic device according to claim 2, wherein, if the ambient luminance signal of the current time point changes is equal or beyond a threshold relative to that of the previous time point, the programming instructions further instruct the at least one microcontroller to:

obtain a next intermediate brightness change rate corresponding to the next intermediate backlight brightness value; and adjust to a further next intermediate backlight brightness value according to the next intermediate brightness change rate.

10. The adjustment method according to claim 6, wherein, if the ambient luminance signal of the current time point changes below a threshold relative to that of the previous time point, the first target backlight brightness value of the current time point is the first intermediate backlight brightness value.

11. The adjustment method according to claim 6, wherein if the ambient luminance signal of the current time point changes is equal or beyond a threshold relative to that of the previous time point, the adjusting from a first initial backlight brightness value to the first target backlight brightness value step by step further comprises:

obtaining a next intermediate brightness change rate corresponding to the next intermediate backlight brightness value; and adjusting to a further next intermediate backlight brightness value according to the next intermediate brightness change rate.

12. A non-transitory computer readable medium storing instructions to cause an electronic device to perform operations comprising:

acquiring an ambient luminance signal of a current time point;

obtaining through calculation a first target backlight brightness value of the electronic device at the current time point according to the ambient luminance signal of the current time point; and if the electronic device is in a normal screen-on state, adjusting from a first initial backlight brightness value to the first target backlight brightness value step by step, wherein the first initial backlight brightness value is a first target backlight brightness value of the electronic device at a previous time point, wherein the adjusting from a first initial backlight brightness value to the first target backlight brightness value step by step comprises:

acquiring an initial brightness change rate corresponding to the first initial backlight brightness value, and adjusting to a first intermediate backlight brightness value according to the initial brightness change rate;

obtaining an intermediate brightness change rate corresponding to the first intermediate backlight brightness value; and adjusting to a next first intermediate backlight brightness value according to the intermediate brightness change rate.

13. The computer readable medium according to claim 12, wherein the obtaining through calculation a first target backlight brightness value of the electronic device at the current time point according to the ambient luminance signal of the current time point comprises:

performing filtering processing on the ambient luminance signal of the current time point to obtain an after-filtering ambient luminance signal of the current time point; and if the after-filtering ambient luminance signal of the current time point changes relative to an ambient luminance signal of the previous time point, obtaining through calculation the first target backlight brightness value of the electronic device at the current time point according to the after-filtering ambient luminance signal of the current time point.

14. The computer readable medium according to claim 12, wherein the operations further comprise:

acquiring a second target backlight brightness value of the electronic device at the current time point according to an image input to the electronic device; and multiplying the first target backlight brightness value and the second target backlight brightness value to obtain a third target backlight brightness value, so that the electronic device adjusts backlight brightness according to the third target backlight brightness value.

15. The computer readable medium according to claim 12, wherein, if the ambient luminance signal of the current time point changes below a threshold relative to that of the previous time point, the first target backlight brightness value of the current time point is the first intermediate backlight brightness value.

16. The computer readable medium according to claim 12, wherein if the ambient luminance signal of the current time point changes is equal or beyond a threshold relative to that of the previous time point, the adjusting from a first initial backlight brightness value to the first target backlight brightness value step by step further comprises:

obtaining a next intermediate brightness change rate corresponding to the next intermediate backlight brightness value; and adjusting to a further next intermediate backlight brightness value according to the next intermediate brightness change rate.

17. The electronic device according to claim 1, wherein performing filtering processing on the ambient luminance signal of the current time point for smoothing the ambient luminance signal of the current time point comprising using one or more of an average method, a weighting method, or an interpolation method.

18. The electronic device according to claim 1, wherein performing filtering processing on the ambient luminance signal of the current time point for smoothing the ambient luminance signal of the current time point comprising using a first-order lag filtering algorithm.

19. The adjustment method according to claim 5, wherein performing filtering processing on the ambient luminance signal of the current time point for smoothing the ambient luminance signal of the current time point comprising using one or more of an average method, a weighting method, or an interpolation method.

20. The computer readable medium according to claim 12, wherein performing filtering processing on the ambient luminance signal of the current time point for smoothing the ambient luminance signal of the current time point comprising using one or more of an average method, a weighting method, or an interpolation method.

* * * * *